US005695359A

United States Patent [19]

Fujikura et al.

[11] Patent Number: 5,695,359

[45] Date of Patent: Dec. 9, 1997

[54] ZERO INSERTION FORCE ELECTRICAL CONNECTOR FOR FLAT CABLE

[75] Inventors: Mitsuo Fujikura, Sagamihara; Minoru Fukushima, Yokohama; Shinsuke Kunishi, Hadano; Masashi Seto, Zama, all of Japan

[73] Assignee: Molex Incorporated, Lisle, Ill.

[21] Appl. No.: 603,825

[22] Filed: Feb. 20, 1996

[30] Foreign Application Priority Data

Feb. 23, 1995 [JP] Japan ..... 7-059896
May 18, 1995 [JP] Japan ..... 7-005735 U

[51] Int. Cl.[6] ..... H01R 23/66

[52] U.S. Cl. ..... 439/495

[58] Field of Search ..... 439/495, 260, 439/492–99, 67

[56] References Cited

U.S. PATENT DOCUMENTS

| | | | |
|---|---|---|---|
| 4,477,137 | 10/1984 | Ayer | 339/59 M |
| 4,630,874 | 12/1986 | Renn et al. | 339/17 F |
| 4,639,063 | 1/1987 | Mueller | 339/75 M |
| 4,936,792 | 6/1990 | Onoue et al. | 439/329 |
| 4,944,690 | 7/1990 | Imai | 439/492 |

FOREIGN PATENT DOCUMENTS

| | | | |
|---|---|---|---|
| 0 618 643 A2 | 10/1994 | European Pat. Off. | H01R 9/07 |
| 0 619 624 A2 | 10/1994 | European Pat. Off. | H01R 9/07 |
| 2-86080 | 3/1990 | Japan | H01R 23/00 |
| 3-163771 | 7/1991 | Japan | H01R 23/00 |
| 4-61883 | 5/1992 | Japan | H01R 23/68 |
| 7-22129 | 1/1995 | Japan | H01R 23/68 |

*Primary Examiner*—Neil Abrams
*Assistant Examiner*—Eugene G. Byrd
*Attorney, Agent, or Firm*—Stephen Z. Weiss

[57] ABSTRACT

A zero force electrical connector is adapted for terminating a flat cable. The connector includes a dielectric housing mounting a plurality of conductive terminals. The housing has a first end adapted for receiving the flat cable in engagement with the terminals, a rear end and opposite sides. An actuator is mounted to the housing for movement between a first position allowing free insertion of the cable into engagement with the terminals and a second position biasing the cable against the terminals. Complementary interengaging stops are provided between the housing and the actuator near the rear end of the housing for limiting rotation of the actuator relative to the housing in a first direction. Complementary interengaging latches are provided between the housing and the actuator near the front end of the housing for preventing rotation of the actuator relative to the housing in a second direction opposite the first direction.

10 Claims, 11 Drawing Sheets

ZERO INSERTION FORCE ELECTRICAL CONNECTOR FOR FLAT CABLE

FIELD OF THE INVENTION

This invention generally relates to the art of electrical connectors and, particularly, to electrical connectors for terminating flat cables, such as a flat flexible cables, without requiring any insertion force.

BACKGROUND OF THE INVENTION

There are a wide variety of zero insertion force electrical connectors particularly adapted for terminating flat cables, such as flexible flat cables. These electrical connectors conventionally use actuators to push the flexible flat cables, flexible printed circuit boards or the like against resilient contacts or terminals which are mounted in the connector housings.

Heretofore, the actuators have been designed to be pushed in and pulled out of the connector housings. Such designs require the application of insertion forces to the flat cables. In addition, such designs have inevitably resulted in an increase in the overall size of the connectors.

Consequently, some zero insertion force electrical connectors for flat cables have been designed with actuators which are pivotable between first, open positions allowing free insertion of the cables into the connector housings, and second, closed positions for clamping the flat cables against the terminals. In some such connectors, lock means are provided to hold the actuators in locked condition relative to the connector housing.

The present invention is directed to a new and improved zero insertion force electrical connector for flat cables wherein the actuator is rotatably mounted on the connector housing by a floating-pivot means and includes an improved locking or latching means to hold the actuator in its terminating position, while still allowing the actuator to rotate to an open position generally perpendicular to the flat cable to allow for visual inspection of the engagement of the cable and the terminals.

SUMMARY OF THE INVENTION

An object, therefore, of the invention is to provide a new and improved zero insertion force electrical connector for flat electrical cable, of the character described.

In the exemplary embodiment of the invention, the zero insertion force electrical connector includes a dielectric housing mounting a plurality of conductive terminals. The housing has a front end adapted for receiving the flat cable in engagement with the terminals, a rear end and a opposite sides. An actuator is mounted to the housing for rotational and translational movement between a first position allowing free insertion of the flat cable into engagement with the terminals and a second position clamping the cable against the terminals. Complementary interengaging mounting means are provided between the housing and the actuator at opposite sides of the housing intermediate the front and rear ends thereof. Complementary interengaging stop means are provided between the housing and the actuator near the rear end of the housing for limiting rotation of the actuator relative to the housing in a first direction. Complementary interengaging latch means are provided between the housing and the actuator near the front end of the housing for preventing rotation of the actuator relative to the housing in a second direction opposite said first direction.

In at least one embodiment of the invention, the actuator, in its first position, is disposed generally perpendicular to the plane of the flat cable to allow visual inspection of the engagement of the cable and the terminals. The complementary interengaging stop means are adapted to stop rotation of the actuator relative to the housing beyond its second position. The complementary interengaging latch means are adapted to prevent rotation of the actuator relative to the housing from its second position back to its first position.

As disclosed herein, means are provided between the housing and the actuator for providing generally linear or sliding movement of the actuator relative to the housing from the second position to a third, final position. The stop means and the latch means become operative automatically when the actuator moves to its third, final position.

A pair of mounting arms are provided at opposite sides of the actuator. The arms have the mounting means and the stop means thereon. The arms are generally J-shaped, with the mounting means being on the leg of the J-shape, and the stop means being on the distal end of the J-shape. In one embodiment of the invention, a pair of latch arms also are provided at opposite sides of the actuator. The latch arms are generally L-shaped and have the latch means thereon.

Finally, complementary interengaging support means are provided between the housing and the actuator at a rear end of the actuator intermediate opposite sides thereof to prevent bending of the actuator.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1(*b*) is a front elevational view of the electrical connector;

FIG. 2(*b*) is a side elevational view of the connector;

FIG. 3.(*b*) is a vertical section taken generally along line B—B in FIG. 1(*b*);

FIG. 5(*b*) is a top plan view of the actuator;

FIG. 5(*c*) is a front elevational view of the actuator;

FIG. 6(*b*) is a vertical sectional view through the actuator;

DETAILED DESCRIPTION OF THE PREFERRED EMBODIMENTS

Figure 1A:
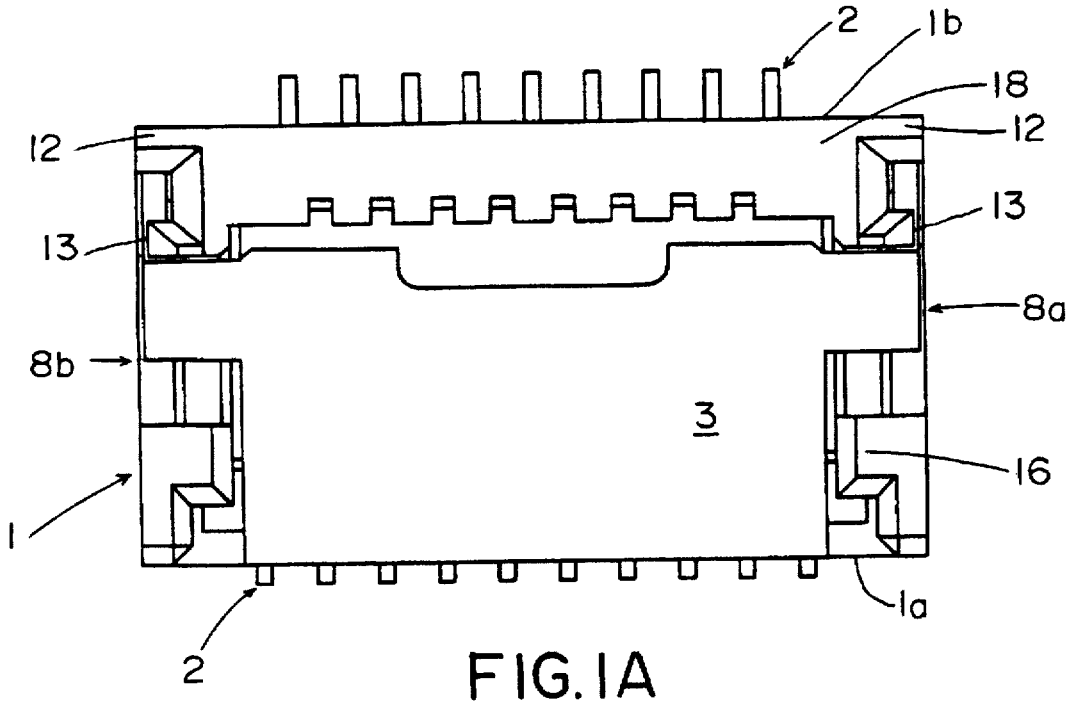
FIG. 1(*a*) is a top plan view of a first embodiment of a zero insertion force electrical connector according to a first embodiment of the invention.
Figure 1B:
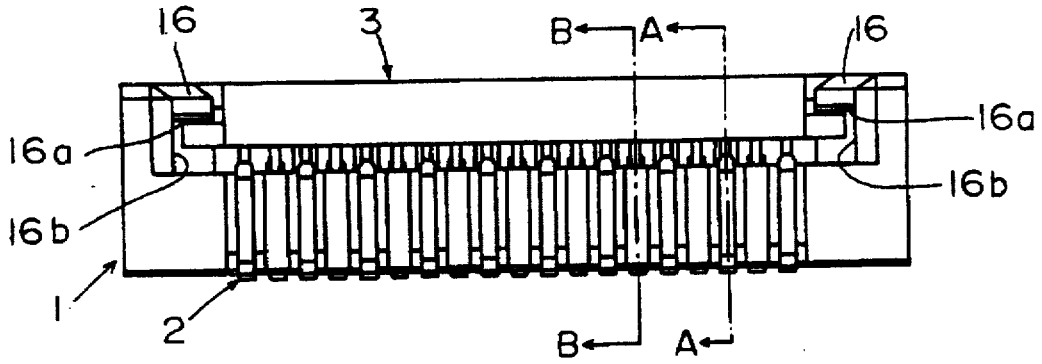

Referring to the drawings in greater detail, and first to FIGS. 1(*a*), 1(*b*) and 2(*a*), a zero insertion force electrical connector according to a first embodiment of the invention, includes a dielectric housing, generally designated 1, a plurality of terminals, generally designated 2, and an actuator, generally designated 3, rotatably mounted on dielectric housing 1.

Figure 3A:
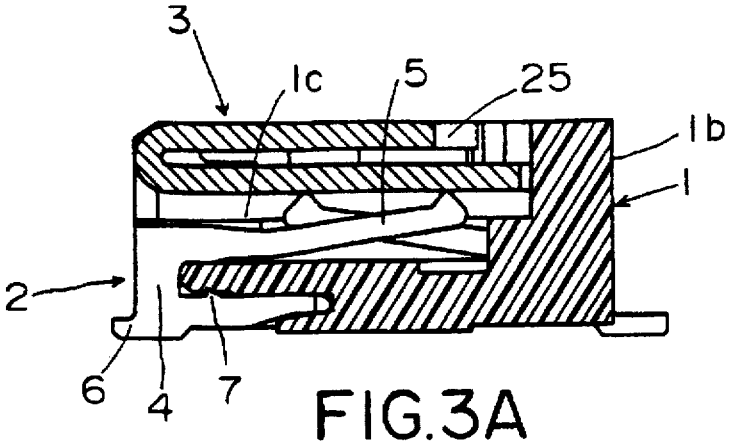
FIG. 3(*a*) is a vertical section taken generally alone line A—A in FIG. 1(*b*)
Figure 3B:
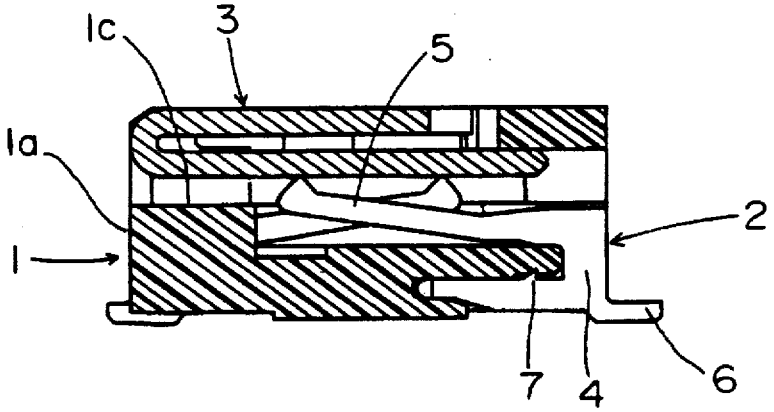

As shown in FIGS. 3(*a*) and 3(*b*), each terminal 2 includes a stem 4, a resilient contact 5 integral with an upper end of the stem and a tail 6 integral with a lower end of the stem. The tail has a spike-like projection or barb 7 formed thereon. Each terminal 2 is mounted in dielectric housing 1 with its spike-like projection 7 embedded in the dielectric material of the housing to prevent the terminal from slipping back out of the housing. It can be seen that the terminals are alternately mounted to the front and rear ends of the dielectric housing.

Specifically, terminals 2 on a front longitudinal end 1(*a*) of the housing are arranged alternately with the terminals 2 on a rear longitudinal end 1(*b*) of the housing. In this manner, the resilient contacts 5 of the terminals are arranged alternately at regular intervals projecting upwardly of a top surface 1(*c*) of the dielectric housing.

Figure 4:
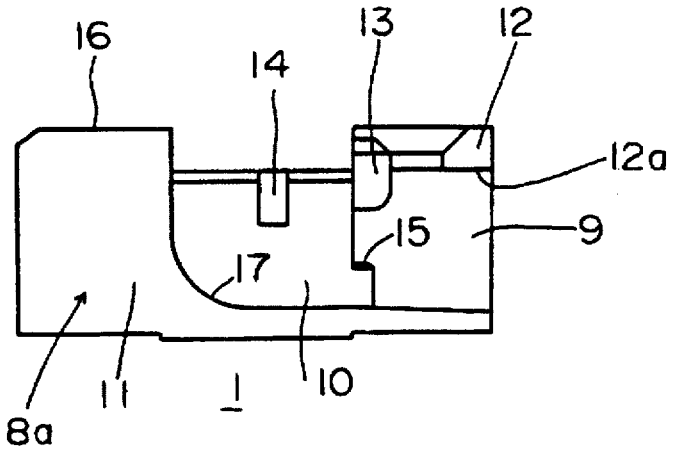
FIG. 4 is a side elevational view of the dielectric housing of the connector.

Referring to FIG. 4 in conjunction with FIGS. 1(*a*)–2(*b*), each lateral side 8*a* and 8*b* of dielectric housing 1 has a step-like configuration as viewed from front-to-rear of the longitudinal sides. Specifically, a first or rear lateral side section 9, a second or intermediate lateral side section 10 and a third or front lateral side section 11 are ranged to progressively step outwardly of the housing in the longitudinal direction. Stated differently, the longitudinal distance between front lateral side sections 11 at opposite ends of the housing is greater than the distance between the second or intermediate lateral side sections 10 at opposite ends of the housing which, in turn, is greater than the distance between the rear side sections 9 at opposite ends of the housing.

Still referring to FIG. 4, the first lateral side sections 9 of the dielectric housing is higher than the level at which terminals 2 are arranged as can be seen in comparing FIGS. 3(*a*) and 3(*b*). Each rear lateral side section 9 has an extension 12 extending outwardly from its upper corner so that the outside surface of extension 12 is flush with the surface of front lateral side section 11. In addition, each rear lateral side section 9 has a projection 13 forwardly of extension 12 and projects outwardly beyond intermediate lateral side section 10 but not quite as far as front lateral side section 11.

Intermediate lateral side section 10 at each opposite end of dielectric housing 1 has a rectangular recess 14 opening at the top thereof as shown clearly in FIG. 4. In addition, each lateral side section 10 has a step extension 15 formed at the lower part thereof projecting into lateral side section 9, again as clearly shown in FIG. 4.

Front lateral side section 11 is as high as rear lateral side section 9, and it has an inner extension 16 (see FIG. 1(*b*)) formed at its top, and a lower extension 16*b* extending from the rear of the front lateral side section, through second lateral side section 10 and into rear lateral side section 9.

Figure 2A:
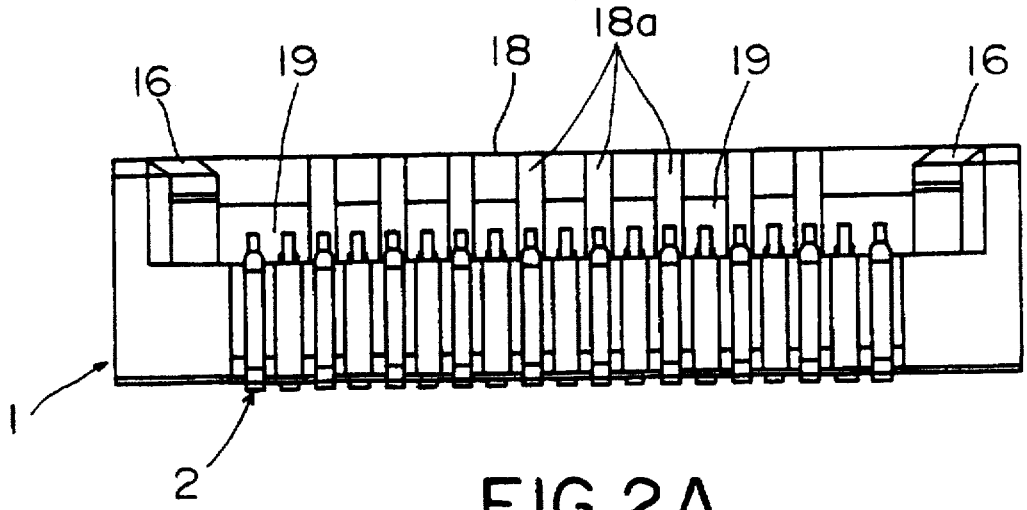
FIG. 2(*a*) is a front elevational view of the dielectric housing of the connector with the actuator removed.
Figure 2B:
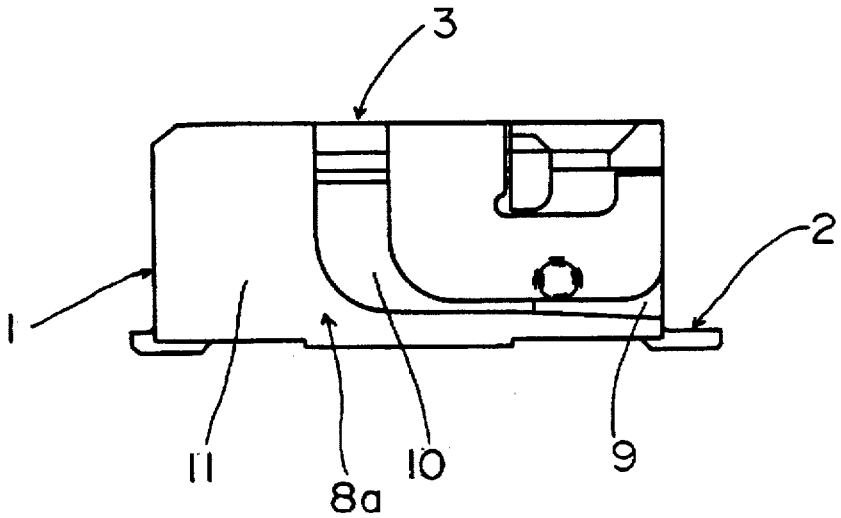

Lastly, dielectric housing 1 includes a longitudinal bridge 18 (see FIG. 2(*a*)) extending between the opposite extensions 12 of lateral side sections 9 at opposite ends of the housing. Rectangular through holes 19 are formed beneath bridge 18 and between a plurality of partitions 18*a*. The through holes are aligned with terminals 2, with the through holes being at rear end 1*b* of the dielectric housing.

Figure 5A:
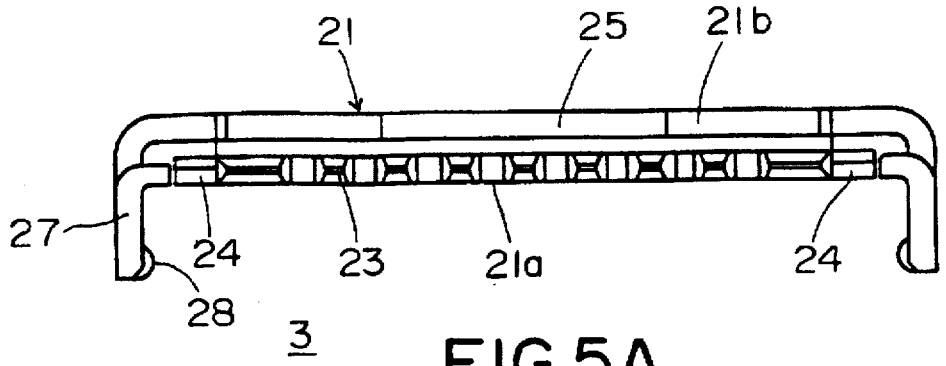
FIG. 5(*a*) is a rear elevational view of the actuator.
Figure 5B:
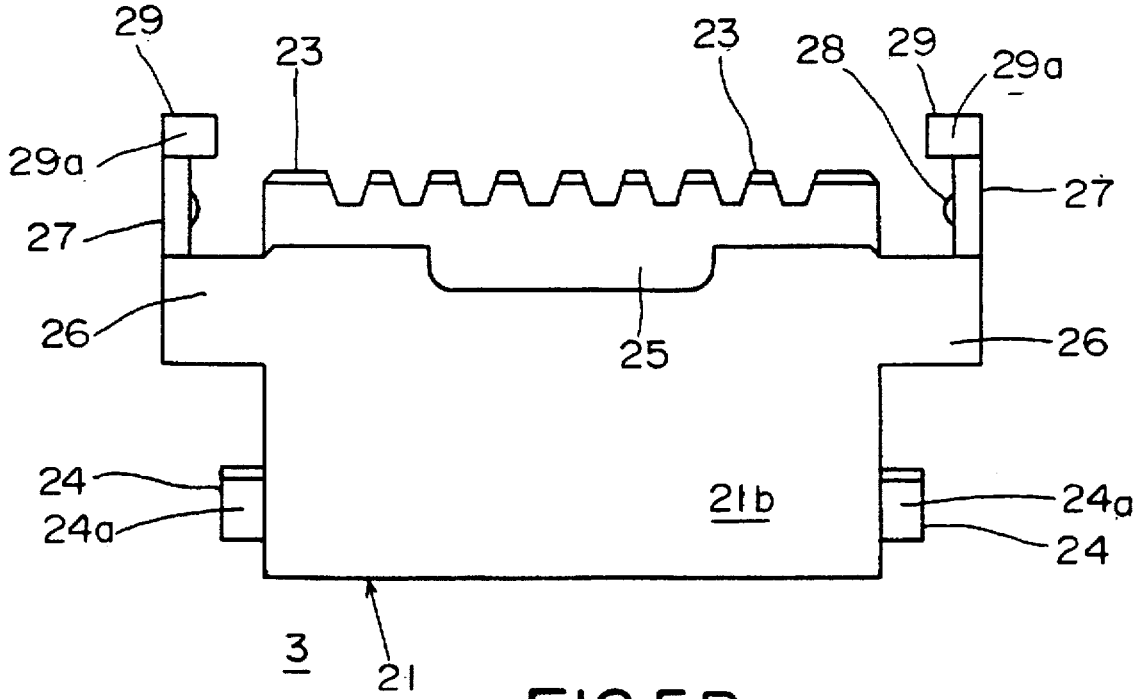
Figure 5C:
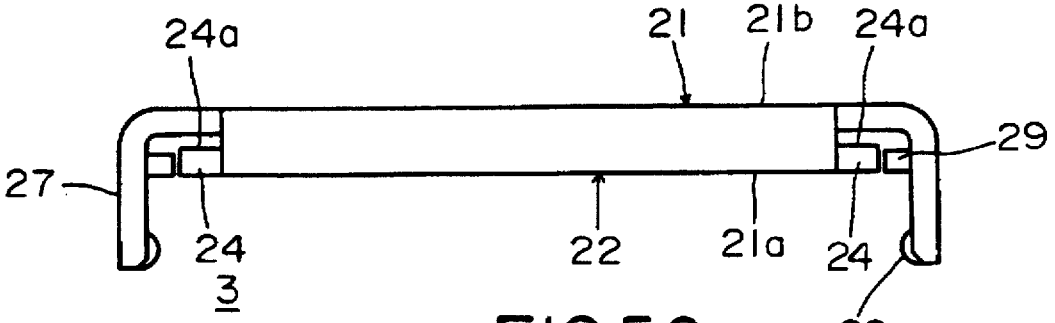

Now, the structure of actuator 3 will be described. Referring to FIG. 5(*a*)–6(*b*), actuator 3 is stamped and formed of stainless steel material coated with an insulating material. The actuator is formed with a U-shaped major part or body 21 which has a lower leg plate 21*a* and an upper leg plate 21*b*. The lower leg plate 21*a* defines an abutment plane, generally designated 22 in FIGS. 6(*a*) and 6(*b*). This abutment plane is adapted to define a lower surface for pushing a flat-type cable, including a flat flexible cable or a flexible printed circuit board against resilient contacts 5 of terminals 2. Lower leg plate 21*a* also has a plurality of rearwardly extending projections or teeth 23 which are positionable into through holes 19 beneath longitudinal bridge 18 of dielectric housing 1. Lastly, lower leg plate 21*a* has laterally outwardly extending projections 24 formed at its lateral opposite sides.

Upper leg plate 21*b* of the U-shaped major part or body 21 is somewhat shorter than lower leg plate 21*a*. The upper leg plate has a notched section 25 at its rearward edge as seen in FIG. 5(*b*), along with laterally outwardly projecting shoulder extensions 26 at its opposite lateral sides. These shoulder extensions 26 have arms 27 extending rearwardly thereof as clearly seen in FIG. 5(*b*).

U-shaped body 21, including upper and lower leg plates 21*a* and 21*b*, respectively, is as wide as the longitudinal arrangement of terminals 2 in dielectric housing 1. The longitudinal distance between arm extensions 27 at opposite sides of body 21 is equal to the longitudinal distance between second lateral side sections 10 at opposite ends of the dielectric housing, thus permitting sandwiching of opposite lateral sides 8*a* and 8*b* of the dielectric housing therebetween.

Figure 6A:
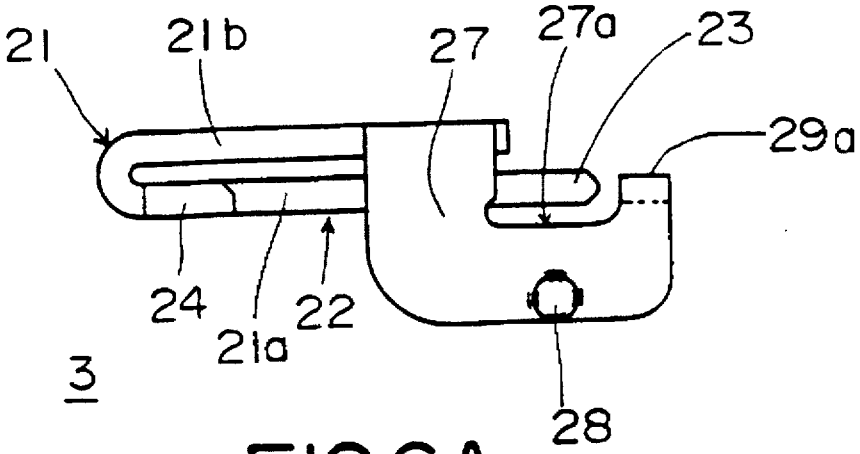
FIG. 6(*a*) is a side elevational view of the actuator.
Figure 6B:
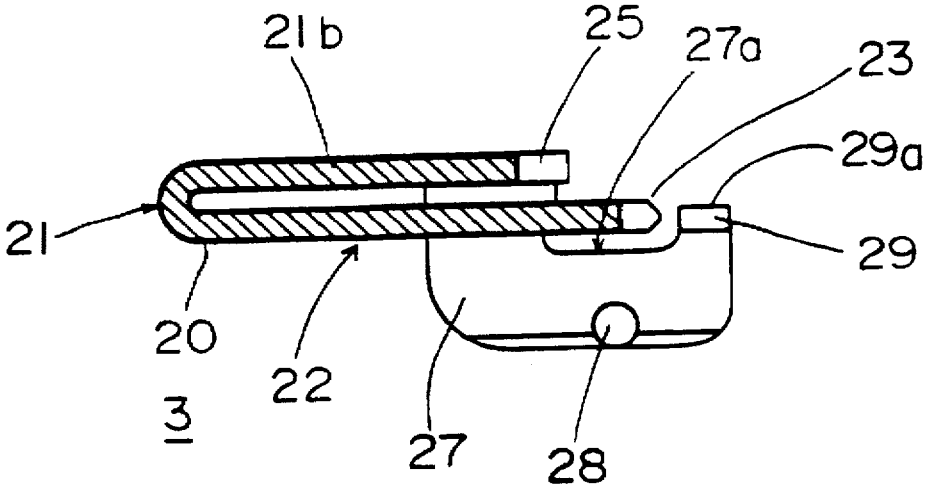
Figure 7C:
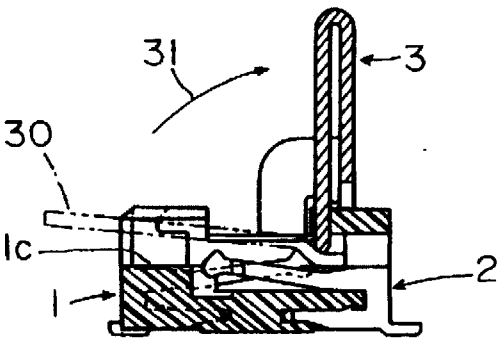
FIGS. 7(*a*)–7(*g*) are sequential views of movement of the actuator relative to the housing from the first, open position of the actuator allowing insertion of the flat cable, to the final locked position of the actuator relative to the housing.
Figure 7F:
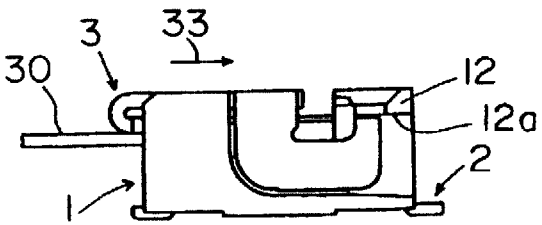
Figure 7G:
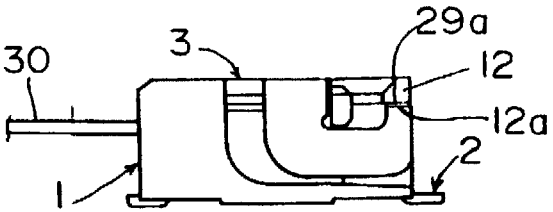
Figure 7B:
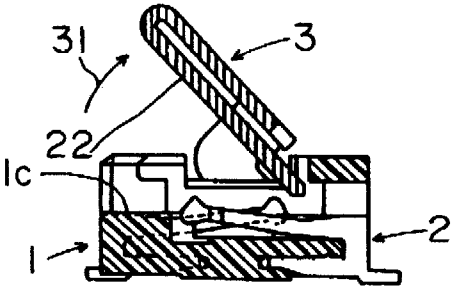
Figure 7E:
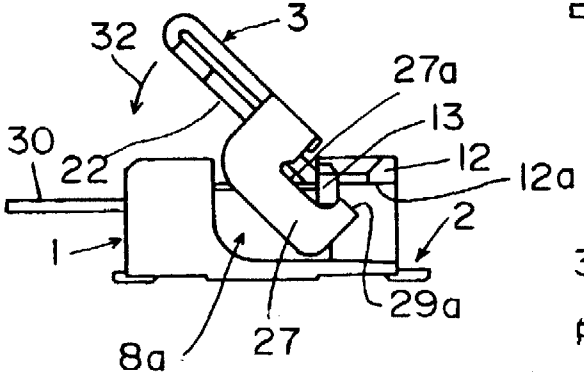
Figure 7A:
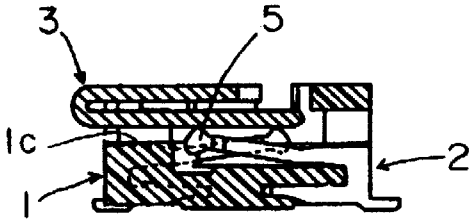
Figure 7D:
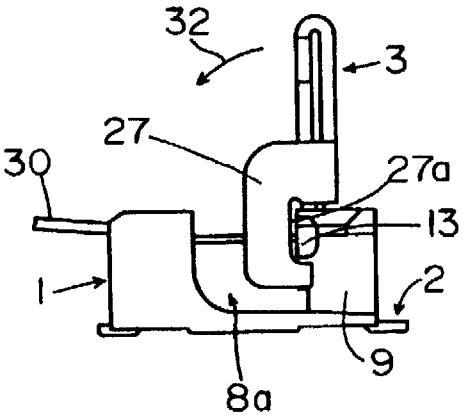

Each arm extension 27 is generally J-shaped as shown in FIGS. 6(*a*) and 6(*b*). Each arm extension has an inside projection or round detent 28 formed intermediate the ends of the leg of the J-shape and an inside rectangular projection 29 formed on the free or distal end of the J-shape.

Referring to FIGS. 7(*a*)–7(*g*), and particularly FIG. 7(*a*), actuator 3 is attached to dielectric housing 1 having terminals 2 mounted thereon, whereby the opposite J-shaped arm extensions 27 of the actuator sandwich second lateral side sections 10 at lateral opposite side 8*a* and 8*b* of the dielectric housing. In order to insert a flat cable, including a flat flexible cable or a flexible printed circuit board 30 into the connector, actuator 3 is rotated in the direction of arrow 31 (FIG. 7(*c*)) to a first position extending upwardly from the dielectric housing generally perpendicular or 90° to surface 1*c* of the housing. In its first position, actuator 3 exposes contacts 5 of the parallel-arranged terminals 2 which project upwardly of surface 1*c* of the dielectric housing.

The upper position of actuator 3 is determined by the engagement of projections 13 of rear lateral side sections 9 and arm extensions 27 of the actuator. This permits rotation of the actuator to its upwardly projecting first position which "opens" the connector for insertion of the flat cable.

When actuator 3 is in its first or open position as shown in FIGS. 7(*c*) and 7(*d*), inside projections 29 at the distal ends of arm extensions 27 abut on the step projections 15 (FIG. 4) of second lateral side sections 10 at opposite ends of the housing, thereby stopping further rotation of the actuator. In this position, rearwardly extending projections or teeth 23 (FIG. 5(*b*)) at the rear longitudinal edge of actuator 3 abut on the top surface of longitudinal bridge 18 of dielectric housing 1.

With actuator 3 in its first or open position, exposing resilient contacts 5 of terminals 2, the flat cable 30 is placed on the parallel arrangement of resilient terminal contacts 5. Due to the full exposure of the terminal contacts, the registration or alignment between the conductors of the flat cable and the resilient terminal contacts can be confirmed by visual inspection, and inspection of the integrity of the terminal contacts also can be easily made because of the full open position of the actuator.

After flat cable 30 is positioned on terminal contacts 5 with zero insertion force, actuator 3 is rotated in the direction of arrow 32 (FIGS. 7(*d*) and 7(*e*)) until round projections 28 at the inside of arm extensions 27 fall into recesses 14 (FIG. 4) of second lateral side sections 10 at opposite sides 8(*a*) and 8(*b*) of the dielectric housing. The actuator is rotated further until the actuator is in a second or closed position as shown in FIG. 7(*f*). This rotational movement of the actuator pushes the flat cable into engagement with resilient contacts 5 of terminals 2 and pushes the flat cable into engagement with surface 1*c* of dielectric housing 1, biasing the resilient terminal contacts 5 downwardly.

Rotation of actuator 3 in the direction of arrow 32 is permitted by cooperation of the inner edges 27*a* of J-shaped arm extensions 27 with projections 13 of front lateral side sections 9 at opposite sides 8*a* and 8*b* of dielectric housing 1. In the second or closed position of actuator 3, abutment surface 22 of lower leg plate 21*a* of the U-shaped major part or body 21 of the actuator pushes flat cable 30 against resilient terminal contacts 5, thus making electrical connections between the cable and the contacts.

Finally, as seen in FIG. 7(*f*), actuator 3 is moved linearly in the direction of arrow 33 to a final or third, locked position as shown in FIG. 7(*g*). This linear movement is permitted by cooperation of projections 13 and the inner edges 27*a* of J-shaped arm extensions 27. This linear movement also is permitted as round projections 28 at the inside of arm extensions 27 fall out of recesses 14 of the dielectric housing. In other words, the interengagement of the round projections in the recesses no longer exists, and the actuator can be moved linearly to its final position. In the third or final position of actuator 3 as shown in FIG. 7(*g*), top flat surfaces 29*a* of projections 29 on arm extensions 27 of actuator 3 abut bottom flat surfaces 12*a* of opposite lateral extensions 12 of front lateral side sections 9 at opposite ends of dielectric housing 1. This defines complementary interengaging stop means between the dielectric housing and the actuator near the rear end of the housing for limiting rotation of the actuator relative to the housing in a first direction defined by arrows 32.

At the same time that actuator 3 is moved to its third or final position, top flat surfaces 24*a* (FIG. 5(*b*)) of opposite lateral projections 24 of lower leg plate 21 of the actuator abut bottom flat surfaces 16*a* (FIG. 1(*b*)) of the opposite, inner lateral extensions 16 of dielectric housing 1. This defines complementary interengaging latch means preventing rotation of actuator 3 in a second direction opposite the first direction of arrows 32, and also keeping the flat cable 30 in electrical contact with resilient terminal contacts 5.

Finally, in the third, final position of actuator 3, projections 23 at the rear longitudinal edge of lower leg plate 21*a* of actuator 3 enter through holes 19 beneath bridge 18 of dielectric housing 1. This prevents undesirable bending of the lower leg plate of the actuator and, thereby, maintains the flat cable in solid electrical contact with the resilient terminal contacts 5.

When disconnecting flat cable 30 from the electrical connector, actuator 3 is raised by inserting an appropriate tool or an operator's finger into notched section 25 (FIG. 5(*b*)) of upper leg plate 21*b* of actuator 3 and pulling on the actuator in a direction opposite the direction of arrow 33 (FIG. 7(*f*)). This unlocks the actuator relative to the housing by disengaging flat surfaces 12*a* and 29*a* as well as flat surfaces 16*a* and 24*a*, to allow the actuator to be rotated and raised from its second position shown in FIG. 7(*f*) back to its first position shown in FIGS. 7(*d*) and 7(*c*), i.e. opposite the direction of arrows 32.

Figure 8:
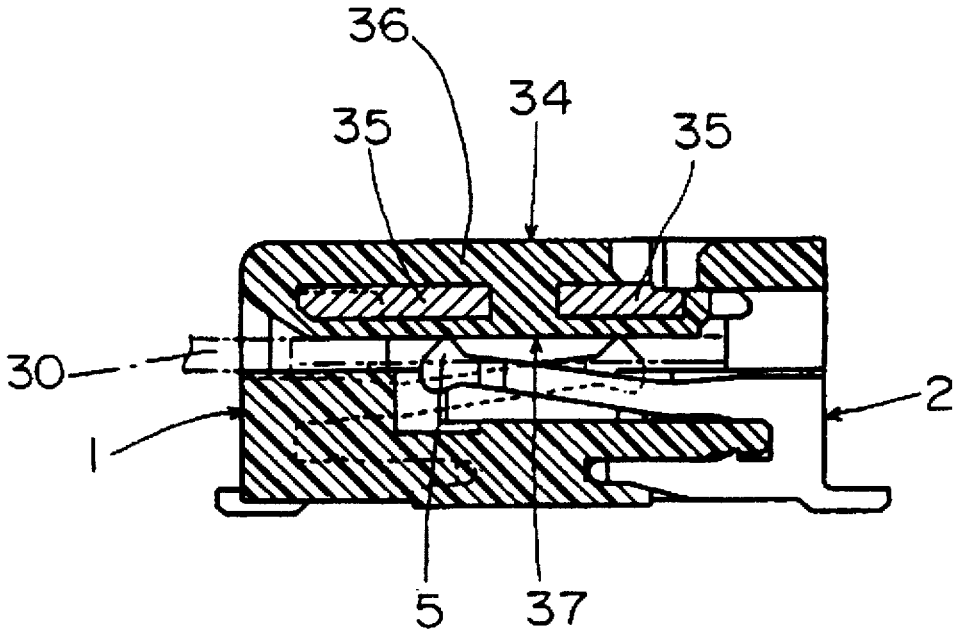
FIG. 8 is a vertical section through a zero insertion force electrical connector according to a modified embodiment of the invention.

FIG. 8 shows an electrical connector according to a modified embodiment of the invention. The modified embodiment is different from the first embodiment only to the extent that its actuator 34 has a sheet metal (stainless steel) core 35 coated with a synthetic resin material 36. The lower leg plate of the resin-coated actuator provides an abutment plane 37 to push flat cable 30 against the underlying terminal contacts 5. The electrical connector is used in the same manner as the electrical connector of the first embodiment described above to make electrical contact between the conductors of the flat cable and the terminal contacts.

It should be understood that the number of parallel-arranged terminals 2 can vary considerably in number. The longitudinal lengths of actuator 3 and dielectric housing 1 also may vary accordingly.

FIGS. 9–19 show a second embodiment of the invention which is very similar to the first embodiment described above and shown in FIGS. 1(*a*)–7(*g*). Consequently, the identical or similar structures or components of the connector including the dielectric housing 1, the terminals 2 and the actuator 3 will not be described again, and like reference numerals have been applied in FIGS. 9–19 corresponding to like components described above in relation to FIGS. 1(*a*)–7(*g*).

One of the differences in the second embodiment of the invention is that, although J-shaped arm extensions 27 have round projections 28 on the insides thereof, the round projections do not fall into any recesses, such as recesses 14 (FIG. 4) of the first embodiment. Round projections 28 of the second embodiment simply bear against the opposite sides of the dielectric housing as the actuator is translationally rotated from its open or cable-loading position to its closed or cable-clamping position.

The principal difference between the second embodiment and the first embodiment, generally, resides in the structural arrangement of the complementary interengaging latch means between dielectric housing 2 and actuator 3 near the front end of the housing, the latch means becoming operative when the actuator is linearly moved to its final position. More particularly, as best seen in FIGS. 9, 15, 16, 18 and 19, an L-shaped latch arm 40 defines a proximal or generally vertically extending leg 40*a* and a distal or generally horizontally extending leg 40*b* of the L-shape. One of these L-shaped latch arms 40 are located on each opposite side of the actuator. In addition, each opposite side of dielectric housing 1 includes an L-shaped latch projection 42 having an upper or generally vertically extending leg 42*a* and a lower or generally horizontally extending leg 42*b*. The juxtapositions of L-shaped latch arms 40 on the actuator, sort of embracing L-shaped latch projections 42 on the housing, when the actuator is in its completely closed, final position is clearly shown in FIG. 9.

Figure 15:
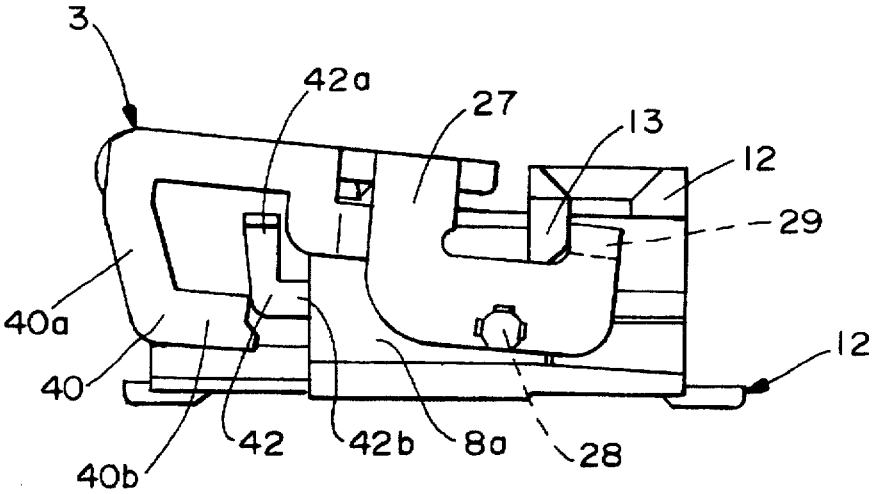
FIGS. 15 and 16 are sequential views illustrating the position of the actuator relative to the housing in moving the actuator upwardly to allow insertion of a flat cable.

In operation of the second embodiment, and referring specifically to FIGS. 15–19, actuator 3 is pulled forwardly until L-shaped latch arms 40 of the actuator are clear of L-shaped latch projections 42 of the housing as shown in FIG. 15. As with the first embodiment, this forward position of the actuator is defined by the abutment of inside projections 29 of J-shaped arm extensions 27 on the actuator with outwardly extending projections 13 on the housing.

Figure 16:
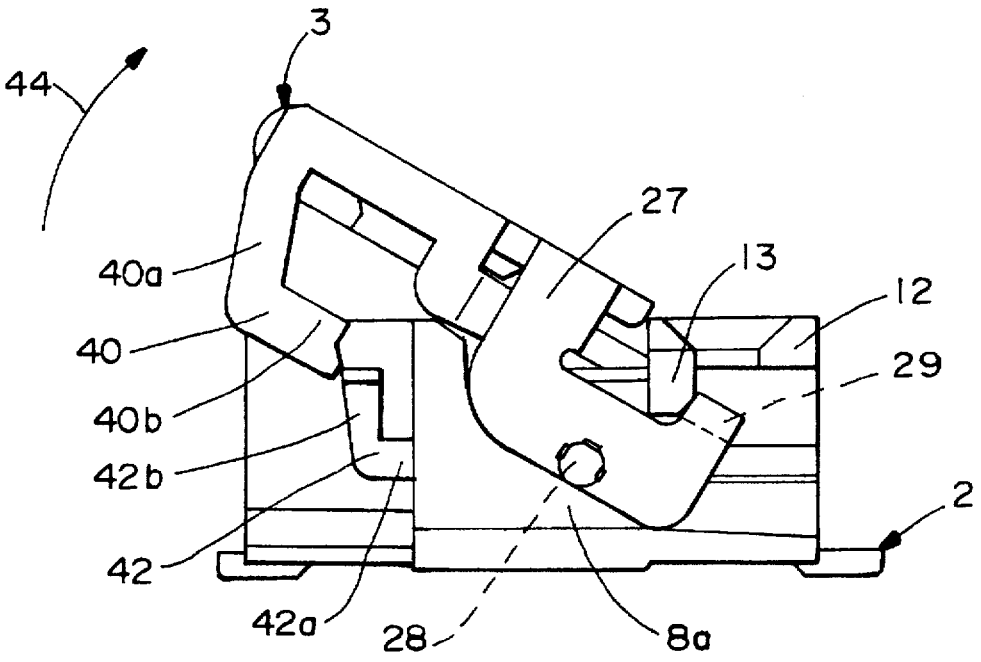
Figure 17:
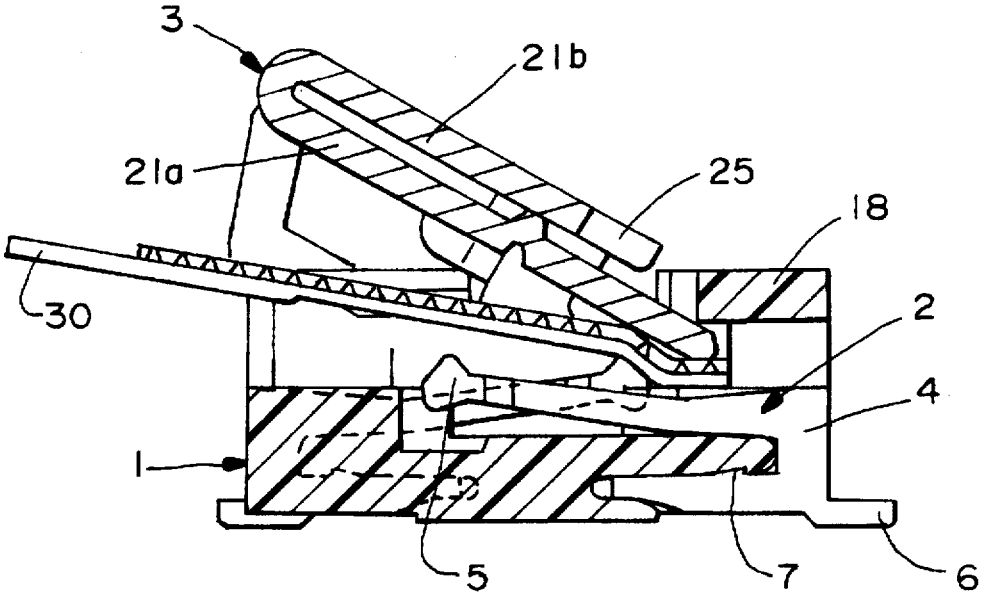
FIG. 17 is a vertical section through the connector, showing a flat cable having been inserted into the connector, with the actuator elevated.

The actuator now is free to be rotated upwardly in the direction of arrow 44 as shown in FIG. 16. A flat cable 30 then is insertable into the connector as shown in FIG. 17 and as described above in relation to the first embodiment of the invention.

Figure 18:
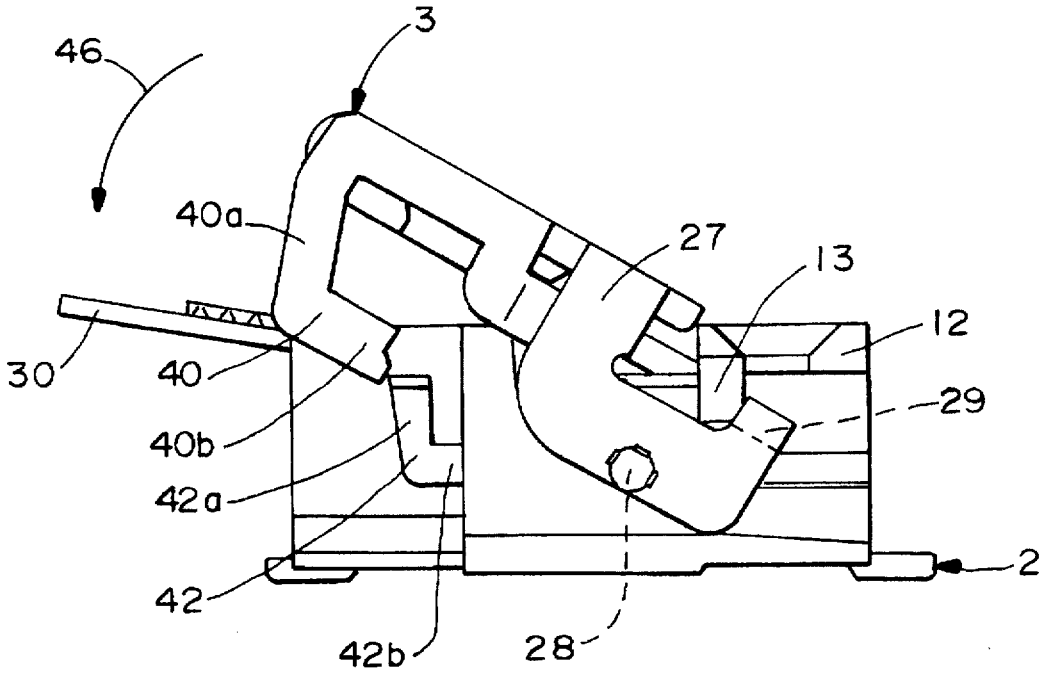
FIGS. 18 and 19 are sequential views showing movement of the actuator downwardly after the flat cable has been inserted.

With the flat cable fully inserted into the connector, actuator 3 then can be rotated back downwardly in the direction of arrow 46 in FIG. 18 as L-shaped latch arms 40 on the actuator clear L-shaped latch projections 42 on the housing.

Figure 19:
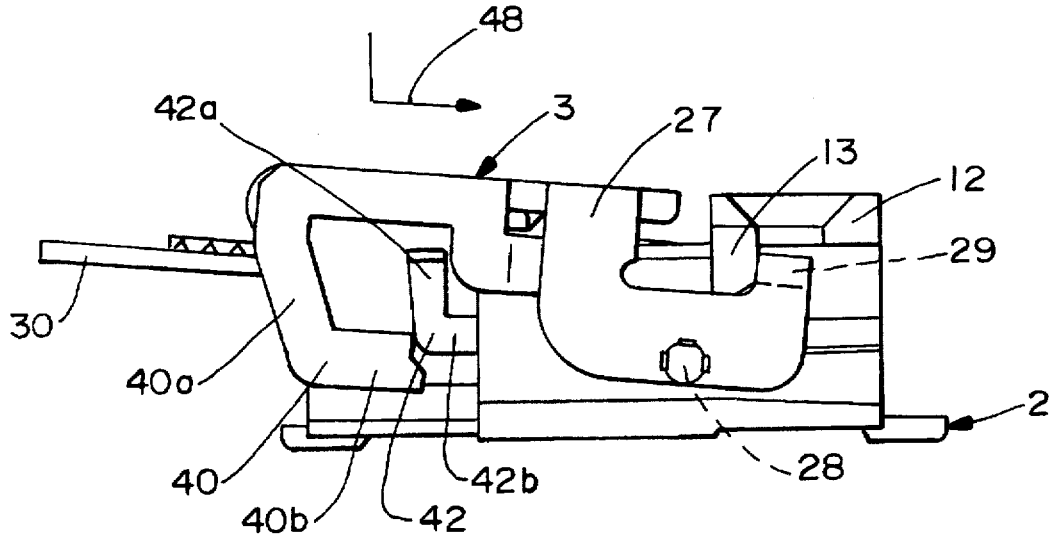

Continued rotation of the actuator downwardly and forwardly in the direction of L-shaped arrow 48 in FIG. 19 moves the actuator to its full downward cable-clamping position until bottom legs 40*b* of L-shaped latch arms 40 on the actuator are disposed below bottom legs 42*b* of latch projections 42 on the housing.

Figure 9:
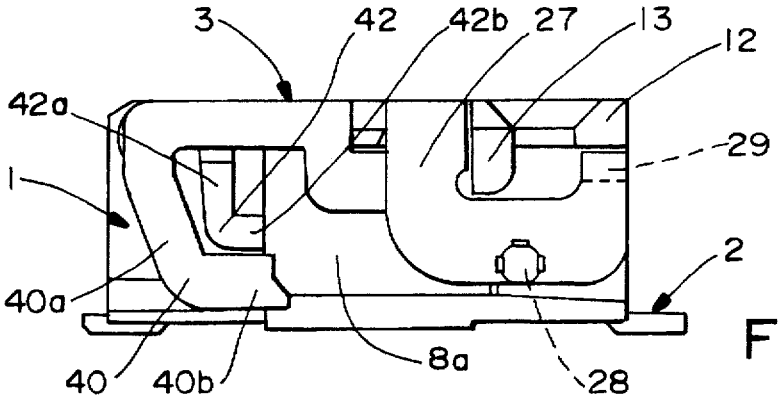
FIG. 9 is a side elevational view of a second embodiment of the invention, similar to the side elevational view of the first embodiment shown in FIG. 2(*b*)
Figure 10:
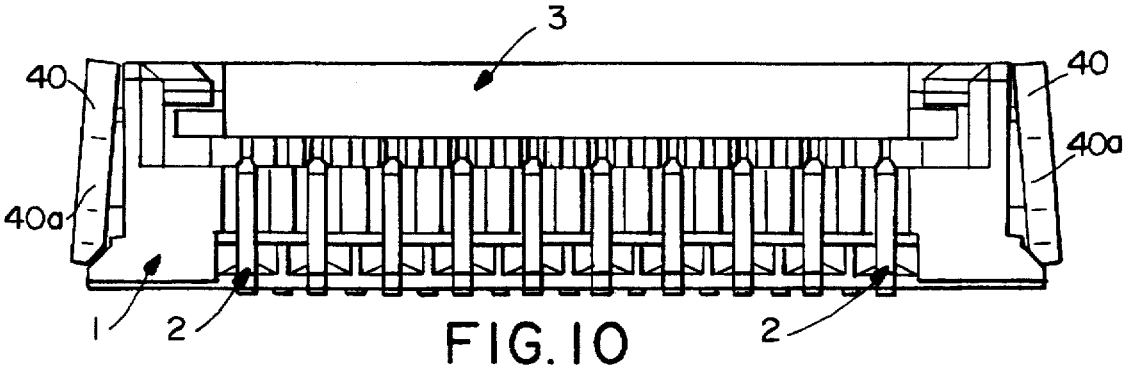
FIG. 10 is a front elevational view of the connector of the second embodiment.
Figure 11:
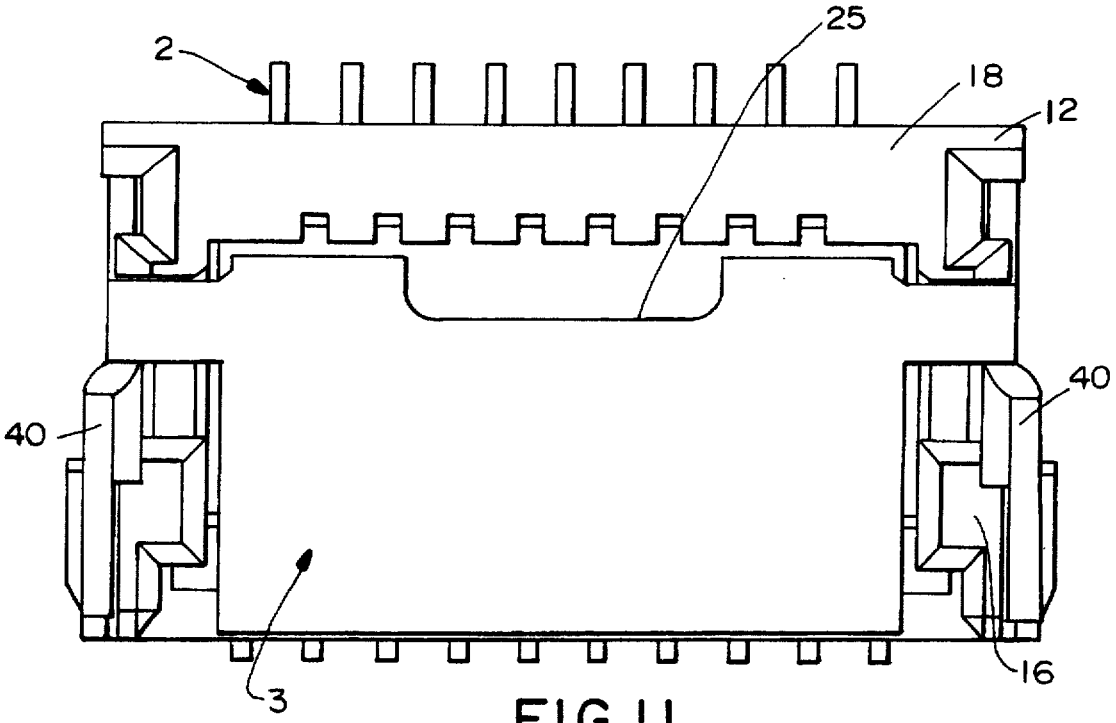
FIG. 11 is a top plan view of the connector of the second embodiment.
Figure 12:
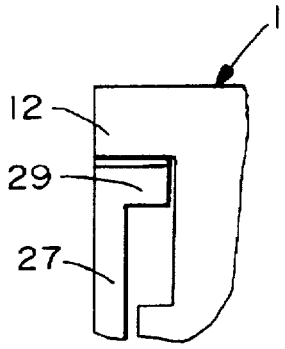
FIGS. 12 and 13 are fragmented plan views of the complementary stop means between the actuator and the housing.
Figure 13:
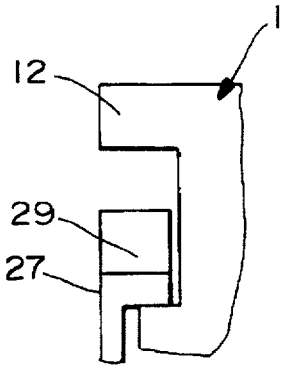
Figure 14:
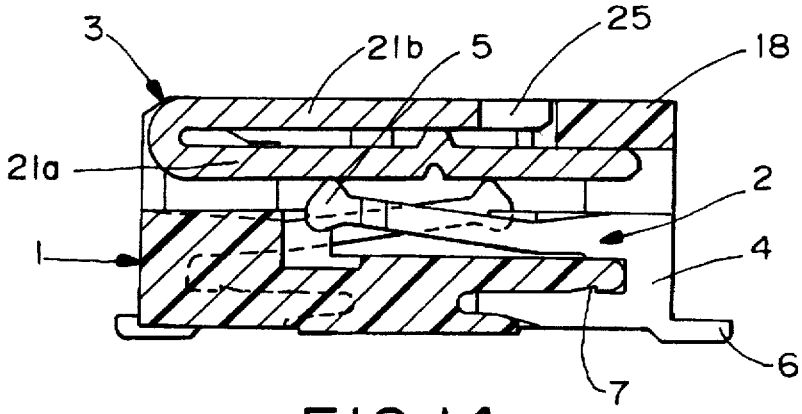
FIG. 14 is a vertical sectional view of the second embodiment similar to the vertical sectional view 3(*b*) of the first embodiment.

When actuator 3 of the second embodiment is in its final position as shown in FIG. 9, bottom horizontal legs 40*b* of latch arms 40 of the actuator are located beneath bottom horizontal legs 42*b* of latch projections 42 of the housing, and the latch means created thereby prevent rotation of the actuator in the direction of arrow 44 (FIG. 16). Of course, rotation of the actuator in the opposite direction is prevented by the interengagement of projections 29 on J-shaped arm extensions 27 of actuator 3 and lateral extensions 12 at the front of dielectric housing 1, as in the first embodiment of the invention.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A zero insertion force electrical connector for a flat cable, comprising:

a dielectric housing mounting a plurality of conductive terminals, the housing having a front end adapted for receiving the flat cable in engagement with the terminals, a rear end and opposite sides;

an actuator mounted to the housing for movement between a first position allowing free insertion of the flat cable into engagement with the terminals and a second position biasing the cable against the terminals;

complementary interengaging mounting means between the housing and the actuator at the opposite sides of the housing intermediate the front and rear ends thereof;

complementary interengaging stop means between the housing and the actuator near the rear end of the housing for limiting rotation of the actuator relative to the housing;

complementary interengaging latch means between the housing and the actuator near the front end of the housing for preventing rotation of the actuator relative to the housing from said second position back to said first position; and, mounting arms at opposite sides of said actuator having said mounting means and said stop means thereon.

2. The zero insertion force electrical connector of claim 1 wherein said complementary interengaging stop means are adapted to stop rotation of the actuator relative to the housing beyond said first position away from said second position.

3. The zero insertion force electrical connector of claim 1 wherein said complementary interengaging latch means are adapted to prevent rotation of the actuator relative to the housing from said second position back to said first position.

4. The zero insertion force electrical connector of claim 1 wherein said mounting means further provides generally linear movement of the actuator relative to the housing from said second position to a third, final position.

5. The zero insertion force electrical connecter of claim 4 wherein said stop means being engageable when the actuator is in its third, final position to stop rotation of the actuator relative to the housing beyond said second position.

6. The zero insertion force electrical connector of claim 1 wherein said arms are generally J-shaped with said stop means being on the distal end of the J-shape.

7. The zero insertion force electrical connector of claim 1, including complementary interengaging support means between the housing and the actuator at a rear end of the actuator intermediate opposite sides thereof to prevent bending of the actuator.

8. The zero insertion force electrical connector of claim 1 wherein said actuator, in said first position, is disposed generally perpendicular to the plane of the flat cable to allow visual inspection of the engagement of the cable and the terminals.

9. The zero insertion force electrical connector of claim 1 wherein said complementary interengaging latch means includes a pair of L-shaped latch arms at opposite sides of the actuator for engaging latch projections at opposite sides of the dielectric housing.

10. The zero insertion force electrical connector of claim 9 wherein said latch projections on opposite sides of the housing also are generally L-shaped but smaller than the L-shaped latch arms for nesting within the arms.

* * * * *